United States Patent [19]

Queille

[11] Patent Number: 4,769,090

[45] Date of Patent: Sep. 6, 1988

[54] RAPID CARBURIZING PROCESS IN A CONTINUOUS FURNACE

[75] Inventor: Philippe Queille, Viroflay, France

[73] Assignee: L'Air Liquide, Paris, France

[21] Appl. No.: 883,927

[22] Filed: Jul. 10, 1986

[30] Foreign Application Priority Data

Aug. 14, 1985 [FR] France ..... 85 12380

[51] Int. Cl.[4] ..... C21D 1/74

[52] U.S. Cl. ..... 148/16.5; 148/128

[58] Field of Search ..... 148/16.5, 16, 128

[56] References Cited

U.S. PATENT DOCUMENTS

| | | | |
|---|---|---|---|
| Re. 26,935 | 8/1970 | Cullen | 148/16.5 |
| 2,955,062 | 9/1977 | Cullen | 148/16.5 |
| 4,049,472 | 9/1977 | Arndt | 148/16 |
| 4,145,232 | 3/1979 | Solomon | 148/16.5 |
| 4,175,986 | 11/1979 | Ewalt et al. | 148/16.5 |
| 4,201,600 | 5/1980 | Luitem | 148/16.5 |
| 4,306,918 | 12/1981 | Kaspersma et al. | 148/16.5 |
| 4,519,853 | 5/1985 | Kostelitz et al. | 148/16.5 |

FOREIGN PATENT DOCUMENTS

| | | |
|---|---|---|
| 0049532 | 10/1986 | European Pat. Off. . |
| 0049531 | 10/1986 | European Pat. Off. . |
| 3310733 | 10/1986 | Fed. Rep. of Germany . |
| 439241 | 10/1986 | France . |
| 2092183 | 10/1986 | United Kingdom . |

OTHER PUBLICATIONS

Chemical Abstracts vol. 87, No. 6, 1977.

Jansen, S. "Productivity Increase in Pusher Furnaces Using UCAR Protective Atmospheres from Nitrogen and Methanol", WESTEC 1982 conference paper.

Heat Treatment of Metals, v. 1976.1, pp. 15–18, "Nitrogen-Based Carbon Controlled Atmosphere—an Alternative to Endothermic Gas".

Proceedings of the 18th International Conference on Heat Treatment of Materials, pp. 454–465, "Direct Atmosphere Generation and Control in Heat Treatment Furnaces".

American Society for Metals, v. 1, No. 2–23, "Application of Instrumentation to Achieve Precision Carburizing".

British Steel Corporation, Apr. 1976, "Optimization Model of a Two Stage Boost/Diffusion Treatment".

American Society for Metals, v. 2, 8th ed., 1964, pp. 67–114, "Heat Treating, Cleaning and Finishing".

Amerian Society for Metal, 1964, "Gas Carburizing", 1964.

Iron and Steel Institute, Mar. 1950, "The Diffusion of Carbon and the Carburizing Process".

*Primary Examiner*—Christopher W. Brody

*Attorney, Agent, or Firm*—Lee C. Robinson, Jr.

[57] ABSTRACT

Process in which there are injected a carrier gas and a hydrocarbon capable of producing, at conventional carburizing temperatures, an atmosphere of predetermined composition having a nominal concentration of carbon monoxide, a door of the furnace being opened with a given periodicity to permit the passage of a charge to be carburized, the opening of this door resulting in particular in an increase in the concentration of the oxidizing species in the atmosphere of the furnace. According to the invention, the concentration of carbon monoxide of the atmosphere injected into the furnace is increased with the same periodicity so as to compensate for the increase in the concentration of the oxidizing species of the furnace and thus maintain the carbon potential of the carburizing atmosphere of the furnace substantially constant throughout the duration of the carburization of the workpieces of the charge.

11 Claims, 2 Drawing Sheets

RAPID CARBURIZING PROCESS IN A CONTINUOUS FURNACE

The present invention relates to a rapid carburization process in a closed continuous furnace into which is injected a carrier gas and possibly a hydrocarbon capable of producing, at the usual carburizing temperatures, an atmosphere of predetermined composition having a nominal concentration of carbon monoxide, a door of the furnace being opened with a given periodicity so as to permit the passage of a charge to be carburized, the opening of said door producing in particular an increase in the concentration of the oxidizing species in the atmosphere of said furnace.

A closed continuous furnace is a furnace into which there are introduced at regular intervals of time charges to be treated which are fed at low speed in the furnace and travel in succession through a zone in which the temperature of the charges is increased, a zone in which the workpieces of the charge are carburized, and a zone in which a diffusion is effected in said workpieces. A closed continuous furnace may comprise entrance and exit lock chambers which partly reduce the increase in the concentration of the oxidizing species in the atmosphere, and may also comprise non-fluidtight separating doors between each zone.

The injection of carrier gas and hydrocarbon produces an atmosphere of predetermined composition when the furnace is in equilibrium, i.e. in particular when the doors of the furnace are closed. This atmosphere consists of:

4 to 30% by volume of CO
10 to 60% by volume of $H_2$
10 to 80% by volume of $N_2$
0 to 4% by volume of $CO_2$
0 to 5% by volume of $H_2O$
0 to 10% by volume of hydrocarbon.

In a continuous furnace, the introduction of a charge causes, when a door is opened, large entries of air producing oxidizing species. The increase in the concentration of the oxidizing species in the atmosphere of the furnace results in a rapid decrease in the carbon potential.

It has been proposed to U.S. Pat. No. 4,145,232 to multiply the flow rate of carrier gas by two when the door of the furnace is opened for the introduction of the charge and to return to the usual initial flow rate of carrier gas when the door is closed.

Such a process is unsatisfactory.

Indeed, in such a process, whatever be the high flow rate of carrier gas injected into the furnace, it is not possible to avoid an increase in the oxidizing species in the furnace and therefore an increase in their concentration and a corresponding decrease in the carbon potential.

The carbon potential in the carburizing zone of the furnace in which is produced the equilibrium reaction:

$$2CO \rightleftharpoons C + CO_2,$$

may be defined by the relation:

$$C.P. = k(T) \times \frac{[CO]^2}{[CO_2]}$$

k(T)=const. function of the temperature

[CO]=concentration of carbon monoxide
$[CO_2]$=concentration of carbon dioxide.

Now, whatever be the flow rate of gas injected into the furnace, the concentration of carbon monoxide in the furnace remains substantially constant. Consequently, an increase in the concentration of carbon dioxide necessarily results in a decrease in the carbon potential.

The process according to the invention avoids these drawbacks. It comprises increasing with the same periodicity the concentration of carbon monoxide of the atmosphere injected into the furnace so as to compensate for the increase in the concentration of oxidizing species of the furnace and thus maintain substantially constant the carbon potential of the carburizing atmosphere of the furnace throughout the duration of the carburization of the workpieces. If the carbon monoxide is formed in the furnace after the cracking of one of the source elements of the carrier gas, the increase in the concentration of carbon monoxide is understood as a corresponding increase in the generating element. Thus, in the most usual practice, the carrier gas comprises nitrogen and an alcohol, preferably methanol (or ethanol). The increase in the concentration of carbon monoxide signifies in this case a corresponding increase in the concentration of methanol in the carrier gas.

Preferably, as soon as the door of the furnace is opened the concentration of carbon monoxide of the atmosphere is increased so as to compensate for the increase in carbon dioxide for the purpose of maintaining a substantially constant carbon potential. In order to ensure a rapid renewal of the atmosphere of the furnace, and consequently a more rapid increase in the concentration of carbon monoxide, this increase in the concentration of carbon monoxide will be preferably accompanied by an increase in the carrier gas flow rate.

In this case, there will be preferably employed a carrier gas flow rate 1.5 to 4 times the "nominal" flow rate of carrier gas, corresponding to the charge treating phase (carburization and/or diffusion).

According to a first mode of carrying out the invention, the closure of the door will be awaited before starting the injection of carrier gas with a high concentration. In this way, a saving in carrier gas is achieved since, when the door is opened, the increase in the concentration of oxidizing species cannot be avoided.

According to a preferred mode of carrying out the invention, the opening of the door of the furnace will be preceded by a few instants by an injection of carrier gas having a high concentration of carbon monoxide, this injection being pursued at least until the closure of the door, and possibly after the closure of the latter, under the conditions of duration specified hereinafter. The supercharging of carbon monoxide may be timed when the cycle is carried out in a programmed manner. Thus it is easy to arrange a timing after the closure of the door before returning to the "nominal" carbon monoxide flow rate. Further, a preinitiation of the supercharging of carbon monoxide may be employed in synchronism with the opening of the door.

It will be understood that, in all the cases described hereinbefore, the injection of carrier gas with a high concentration of carbon monoxide may be or may not be accompanied by an increase in the carrier gas flow rate, preferably within the limits mentioned hereinbefore.

In all the modes envisaged hereinbefore, the duration of the injection of carrier gas having a concentration of carbon monoxide higher than the nominal value will be between 5% and 50% of the total duration of the treatment.

The carrier gas having a concentration of carbon monoxide higher than the nominal value will preferably be obtained from a nitrogen-methanol mixture with a volume ratio $$R1 = \frac{[N_2]}{[MeOH]} \text{ such that } 1/20 \leqq R1 \leqq 3/7$$

The carrier gas having a concentration of carbon monoxide equal to the nominal value will also be obtained from a nitrogen-methanol mixture in a voluminal ratio having preferably the value $$R2 = \frac{[N_2]}{[MeOH]} \text{ such that } 3/7 \leqq R2 \leqq 1$$

A better understanding of the invention will be had from the following modes of carrying out the invention given by way of non-limiting examples with reference to the accompanying drawings, in which.

In a continuous furnace, or pusher-furnace, a charge, constituted by workpieces of steel to be carburized, is introduced every few minutes (generally 4 to 20 minutes). This furnace generally comprises in succession an entrance door, an entrance lock chamber, a carburization zone and a diffusion zone, optionally separated by doors, and an exit lock chamber with a quenching bath.

The atmosphere generated in the furnace is of the endothermic type, i.e. principally rich in hydrogen species, carbon monoxide and nitrogen obtained from a generator or from nitrogen and bodies adapted to create in the furnace CO and $H_2$ species, which may be methanol alone (preferred solution), ethanol-oxidizer ($H_2O$, Air, $CO_2$ . . . ) or like mixtures to which may be added up to 10% hydrocarbon ($CH_4$, $C_3H_8$ . . . ) to control the carbon potential and sometimes up to 5% ammonia for special treatments like carbonitriding (carburization activated with ammonia).

For introducing a charge into the furnace, the entrance door is opened, which produces large uncontrolled entries of oxidizing species ($O_2$ or $CO_2$, $H_2O$, issuing from the combustion of the atmosphere of the furnace with the exterior air).

Figure 1:
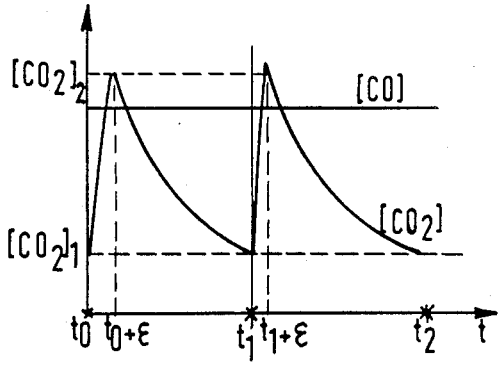
FIGS. 1 and 2 show the variations in the atmosphere according to the prior art.

In presently-known processes (FIGS. 1 and 2), the opening of the door of the furnace periodically at instants $t_0$, $t_1$, $t_2$ . . . , results (FIG. 1) in a very rapid increase in the concentration of carbon dioxide of the atmosphere of the furnace, this concentration passing almost instantaneously (a few tens of seconds or more) from a concentration $[CO_2]_1$, for example of 0.15%, to a concentration $[CO_2]_2$ which may be as much as 1%, namely about 6 times higher (values which vary greatly according to the furnaces and the treatment).

Figure 5:
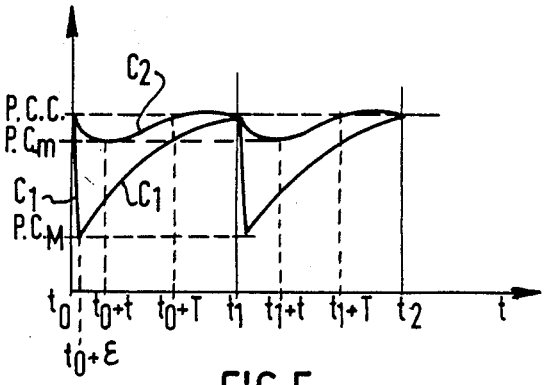
FIGS. 5–8 show the variations in the carbon potential according to the prior art and according to the invention.

Bearing in mind the low concentration of carbon dioxide in the atmosphere of the furnace, the concentration of carbon monoxide may be considered to be constant during the whole of the process. Consequently, the carbon potential varies considerably in the carburizing zone of the furnace in accordance with the curve $C_1$ illustrated in FIG. 5. It may diminish down to a $C.P._M$ value on the order of 0.1 to 0.3% for a carburizing temperature of for example 920° C. (the set value of the carbon potential at this temperature is often on the order of 0.8 to 1.0%.) The reconditioning of the furnace to the set value takes practically the whole of the period of time $t_0$ to $t_1$ between two successive introductions. Under these conditions, the transfer of carbon which only becomes effective at about the C.P value$_m$ (defined hereinafter) which is reached after a period of time T (which period may represent up to one half of the period of time t−t between the introduction of two charges), the carburization of the workpieces during each of the periods T will be practically nil and in certain cases there is even a risk of decarburizing the workpieces in this period.

Consequently, as the carburization has occurred only during the periods of time $t_0+T$ to $t_1$, $t_1+T$ to $t_2$, etc., the depth of the carburization for a given hardness is small. In initially fixing a given depth and hardness, the duration of the carburizing treatment is therefore considerably increased.

Figure 2:
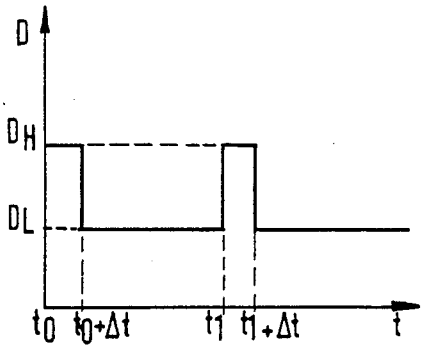

FIG. 2 shows by way of example the carrier gas flow rate injected into the furnace according to the known solution of the aforementioned U.S. patent, this rate having normally the value $D_L$ when the door is closed and a value $D_H$ when the door of the furnace is opened, substantially equal to twice $D_L$ or more.

Figure 3:
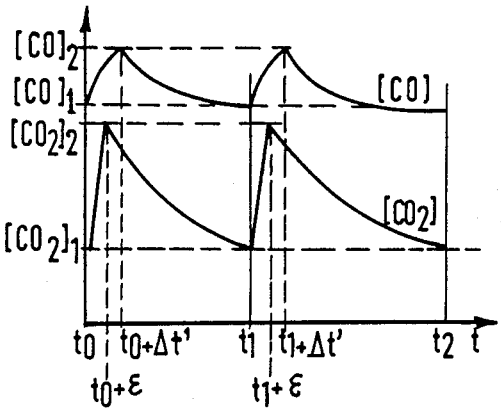
FIGS. 3 and 4 show the variations in the atmosphere according to the invention.
Figure 4:
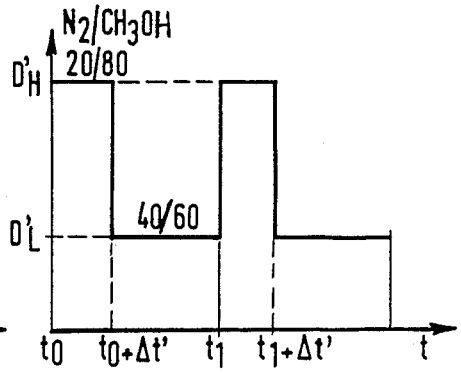

According to the invention (FIGS. 3 and 4), the concentration of carbon monoxide of the atmosphere injected into the furnace is increased when introducing a new charge (or when removing the charge from the furnace if this results in a similar disturbance) or a little before so as to anticipate the increase in the concentration of oxidizing species without reaching a carbon activity of the atmosphere equal to 1, which would produce soot on the parts. This increase in the concentration is generally effected throughout the duration of the opening of the door of the furnace. It generally continues after the closure of this door so as to more rapidly return to the set carbon potential. This measure is doubly favorable, since it permits, on one hand, maintaining the carbon potential of the atmosphere at a sufficient value to ensure that there is a transfer of carbon of the atmosphere to the workpiece, but it also permits, on the other hand, accelerating this transfer to the part, since the speed of transfer of the carbon depends, in the carburizing phase, on the product $pH_2 \times pCO$, which are the respective partial pressures of $H_2$ and CO in the furnace (here equal to the concentrations).

This increase in the concentration of carbon monoxide is achieved by injection into the furnace of carbon monoxide or, preferably, a product capable of being decomposed in the atmosphere of the furnace to produce this carbon monoxide.

In "normal" (closed doors) operation, the atmosphere injected into the furnace is either that of an endogenerator having a constant flow rate, or preferably a nitrogen/methanol mixture or the like as described before. Thus, according to the invention (FIGS. 3, 4 and 5), the injection of carbon monoxide is increased during the time $\Delta t'$, whose concentration passes from $[CO]_1$ (which is generally on the order of 20% by volume) to $[CO]_2$ (which is on the order of 27% by volume).

This results (FIG. 5) in a carbon potential whose variations are represented by the curves $C_2$. The flow rate of this supercharging of carbon monoxide (or of the body which produces it) and its duration will be regulated so as to avoid descending substantially below the $C.P_m$ of the carbon potential, below which value the atmosphere would not be carburizing. For example, for a 16NC6 type of steel and a carburizing temperature of 920° C., these various parameters will be so regulated as to avoid descending below a value of about 0.4% of the carbon potential. Thus, also owing to the increase in the speed of transfer of the carbon, the rapidity of the continuous carburizing processes is increased, everything also being equal.

The simplest method for carrying out the invention is to use a nitrogen-methanol mixture for producing the atmosphere of the furnace and to vary the relative proportions of the nitrogen and methanol.

During the period corresponding to the opening, the proportion of methanol in the mixture is increased; this increase may be as much as to introduce pure methanol during or in the course of this brief period. But it is preferable to maintain at least 10%, and preferably at least 20%, nitrogen in the mixture injected into the furnace.

To be more simple, the flow rate of the mixture and the proportions of the latter may be simultaneously varied so as to maintain the nitrogen flow rate substantially constant. This variant is that shown in FIG. 4 with a flow rate $D_H'$ from $t_0$ to $t_0+\Delta t'$, etc. of a mixture having 20% nitrogen and 80% methanol and a flow rate $D_L'$ lower than $D_H'$ of a mixture containing 40% nitrogen and 60% methanol.

A better understanding of the invention will be had from the following comparative examples:

EXAMPLE 1

This example represents the prior art in typical use up to the present time.

There is effected in a pusher-furnace the carburization of transmission workpieces of 16NC6 grade steel in respect of which the desired carburization depth at 550 VH1 is 0.7 to 0.9 mm. The temperature of the furnace is 920° C., the charges, introduced every 7 minutes, being 150 kg. The carbon potential desired to be maintained in the carburizing zone is 0.8%. The duration of the opening of the charging door at the entrance of the furnace is 27 seconds.

The atmosphere injected into the furnace is obtained from a nitrogen-methanol mixture in the ratio 40/60 (endothermic atmosphere). The flow rate of the injected atmosphere is 19 $m^3/h$. The consumption of atmosphere per cycle (7 minutes) is therefore 2.22 $m^3$.

Figure 6:
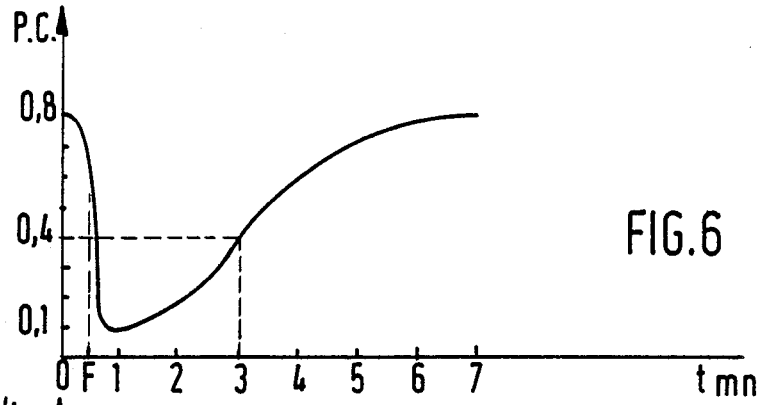

The variations in the carbon potential measured in the furnace are represented in FIG. 6. The carbon potential, which was 0.8% before the opening of the door, drops to 0.1% after one minute, then progressively rises to 0.8% (0.4% after 3 minutes).

EXAMPLE 2

Figure 7:
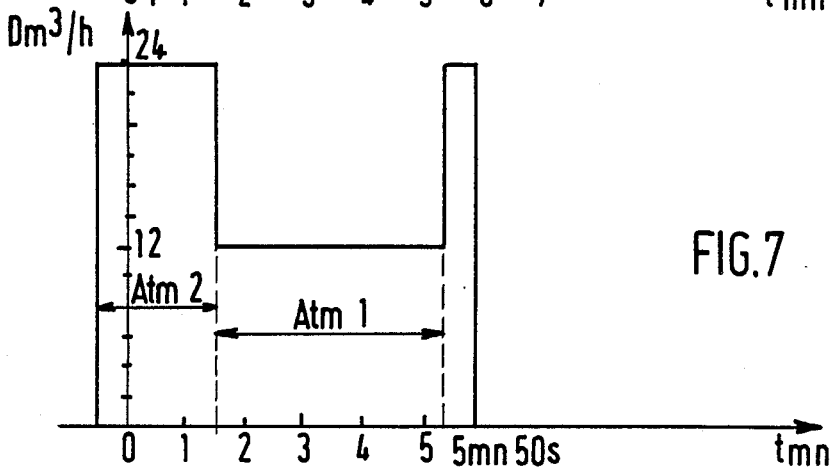

In the same furnace, everything else being equal, the same workpieces are treated to obtain the same final conditions as in Example 1. The atmosphere injected into the furnace in the preceding example is replaced by an atmosphere of variable composition, during variable periods, represented in FIG. 7.

Figure 8:
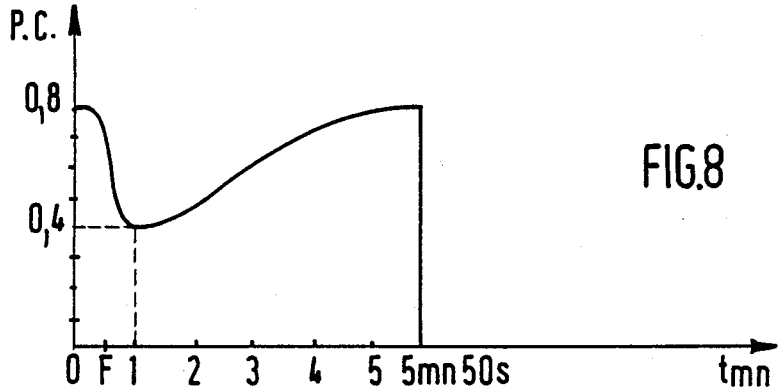

Thirty seconds before the opening of the door and for 2 minutes, the atmosphere Atm 2 is injected with a nitrogen-methanol ratio equal to 20/80 at a flow rate of 24 $m^3/h$. The atmosphere Atm 1 is then injected at a flow rate of 12 $m^3/h$ for 3 minutes and 50 seconds. The consumption of gas during a cycle is 1.57 $m^3$. The variations in the carbon potential are shown in FIG. 8 to scale (note that on the time scale (FIGS. 6, 7 and 8), F represents the instant of the closure of the door of the furnace). The carburized depth a 550 VH1 of the workpieces of the batch is between 0.7 and 0.9 mm.

Thus, the duration of the cycle has been reduced by 17% (from 7 minutes to 5 minutes 50 seconds) and the consumption of atmosphere by 29%. Such a reduction in the times of the cycles, everything else being equal, represents a considerable saving for those skilled in the art.

What is claimed is:

1. A process for rapidly carburizing a workpiece in a closed continuous furnace having a door to permit entry into the furnace, comprising injecting a carrier gas and a hydrocarbon capable of producing, at conventional carburizing temperatures, an atmosphere having a nominal concentration of carbon monoxide, opening said door of the furnace with a given periodicity to permit the passage of a workpiece to be carburized, the opening of said door producing in particular an increase in the concentration of oxidizing species in the atmosphere of the furnace, increasing with the same periodicity of said door openings, and for a duration less than said periodicity, the concentration of carbon monoxide in the atmosphere injected into the furnace, so as to compensate for the increase in the concentration of oxidizing species caused by said opening of said door of the furnace and thus maintain substantially constant the carbon potential of the atmosphere of the furnace throughout the duration of the carburization of said workpiece and wherein the atmosphere having an increased concentration of carbon monoxide obtains said increase at least partly from a nitrogen-methanol mixture with a voluminal ratio $$R1 = \frac{[N_2]}{[MeOH]} \text{ such that } 1/20 \leqq R1 \leqq 3.7,$$

$NH_2$ and MeOH respectively representing the concentrations of nitrogen and methanol.

2. A process according to claim 1, comprising increasing the concentration of carbon monoxide as soon as the door is opened.

3. A process according to claim 2, comprising returning the concentration of carbon monoxide of the injected atmosphere to its nominal value as soon as the door of the furnace is closed.

4. A process according to claim 1, comprising starting to inject the carbon monoxide in increasing concentration a few instants before the opening of the door.

5. A process according to claim 1, comprising injecting the carbon monoxide in increasing concentration as soon as the door is closed, and continuing said injection for the same amount of time the door was opened.

6. A process according to claim 1, comprising injecting the carbon monoxide in increased concentration a few instants before the closing of the door and continuing said injection for the same amount of time the door was opened.

7. A process according to claim 1, comprising returning the concentration of carbon monoxide in the injected atmosphere to the nominal value when the carbon potential measured within the furnace has returned substantially to the nominal value.

8. A process according to claim 1, additionally comprising increasing the flow rate of the atmosphere injected into the furnace during a part of the time that the injection of the atmosphere having a concentration of carbon monoxide higher than the nominal value is occurring.

9. A process according to claim 8, wherein the increase in the flow rate of the injected atmosphere is equal to 1.5 to 4 times the normal flow rate.

10. A process according to claim 8, wherein the duration of the injection of the atmosphere having a concentration of carbon monoxide higher than the nominal value is between 5 and 50% of the total duration of the rapid carburization process.

11. A process according to claim 1, comprising using a mixture of nitrogen and methanol for producing the atmosphere, maintaining the flow rate of nitrogen constant throughout the duration of the process and varying the flow rate of methanol in accordance with variations in the concentration of carbon monoxide in the atmosphere.

* * * * *